US007753652B2

(12) United States Patent
Truckenmueller et al.

(10) Patent No.: US 7,753,652 B2
(45) Date of Patent: Jul. 13, 2010

(54) AERO-MIXING OF ROTATING BLADE STRUCTURES

(75) Inventors: Frank Truckenmueller, Orlando, FL (US); Heinrich Stueer, Haltern (DE); Harry F. Martin, Altamonte Springs, FL (US); Lewis Gray, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 713 days.

(21) Appl. No.: 11/639,962

(22) Filed: Dec. 15, 2006

(65) Prior Publication Data

US 2008/0145228 A1 Jun. 19, 2008

(51) Int. Cl.
*B63H 1/16* (2006.01)

(52) U.S. Cl. ..... 416/189; 416/203; 416/212 A; 416/DIG. 5

(58) Field of Classification Search ..... 416/189, 416/203, 212 R, 212 A, 243, DIG. 5
See application file for complete search history.

(56) References Cited

U.S. PATENT DOCUMENTS 4,512,718 A 4/1985 Stargardter
4,878,810 A 11/1989 Evans
5,286,168 A 2/1994 Smith
5,480,285 A * 1/1996 Patel et al. ..... 416/223 A
5,524,341 A 6/1996 Ferleger et al.
6,390,776 B1 * 5/2002 Gruenwald ..... 416/203
6,428,278 B1 8/2002 Montgomery et al.
6,471,482 B2 10/2002 Montgomery et al.
6,682,306 B2 * 1/2004 Murakami et al. ..... 416/189

FOREIGN PATENT DOCUMENTS

EP 1211383 A2 6/2002
EP 1355043 A1 3/2003
GB 630747 10/1949

* cited by examiner

*Primary Examiner*—Edward Look
*Assistant Examiner*—Ryan H Ellis

(57) ABSTRACT

An array of blades for use in a turbomachine is provided comprising a plurality of blades mounted to a rotor disk. A plurality of first blades form a first set of blades and a plurality of second blades form a second set of blades. A blade-to-blade flow field defined between successive ones of the first set of blades is interrupted by the second set of blades to form an asymmetric blade-to-blade flow field around the array of blades. The trailing edges of the second set of blades are positioned forwardly from a line connecting the trailing edges of the first set of blades such that shock forces in the flow field around the array of blades will generally impinge on a stable region of the first set of blades.

16 Claims, 4 Drawing Sheets

AERO-MIXING OF ROTATING BLADE STRUCTURES

FIELD OF THE INVENTION

The present invention relates generally to an array of flow directing elements for a turbomachine and, more particularly, to a rotor blade array configured to interrupt a shock field downstream of rotor blades in the array and reduce shock induced flutter in the rotor blades.

BACKGROUND OF THE INVENTION

Turbomachinery devices, such as gas turbine engines and steam turbines, operate by exchanging energy with a working fluid using alternating rows of rotating blades and non-rotating vanes. Each blade and vane has an airfoil portion that interacts with the working fluid.

Airfoils have natural vibration modes of increasing frequency and complexity of the mode shape. The simplest and lowest frequency modes are typically referred to as first bending, second bending, and first torsion. First bending is a motion normal to the flat surface of an airfoil in which the entire span of the airfoil moves in the same direction. Second bending is similar to first bending, but with a change in the sense of the motion somewhere along the span of the airfoil, so that the upper and lower portions of the airfoil move in opposite directions. First torsion is a twisting motion around an elastic axis, which is parallel to the span of the airfoil, in which the entire span of the airfoil, on each side of the elastic axis, moves in the same direction.

It is known that turbomachinery blades are subject to destructive vibrations due to unsteady interaction of the blades with the working fluid. One type of vibration is known as flutter, which is an aero-elastic instability resulting from the interaction of the flow over the blades and the blades' natural vibration tendencies. When flutter occurs, the unsteady aerodynamic forces on the blade, due to its vibration, add energy to the vibration, causing the vibration amplitude to increase. The vibration amplitude can become large enough to cause structural failure of the blade. The operable range, in terms of pressure rise and flow rate, of turbomachinery is restricted by various flutter phenomena.

Lower frequency vibration modes, i.e., the first bending mode and first torsion mode, are the vibration modes that are typically susceptible to flutter. In one approach to avoid or reduce flutter, it has been a conventional practice to increase the first bending and first torsion vibration frequencies of the blades, including utilizing mix-tuning principles that promote blade-to-blade differences in blade natural frequency and mode shape.

In highly loaded last row blades of typical power generation steam turbines, one strong contributor to aero-elastic instability is attributed to the shock associated with the supersonic expansion downstream of the blade passage throat, which may be referred to as shock induced flutter. Shock induced flutter may exist under either stalled or unstalled flow conditions, as is referenced to the presence or absence, respectively, of a gross separation of the flow about the airfoil surface as a result of inlet incidence angle effects. Under such conditions, the strength of the destabilizing forces associated with the shock flow field may be increased by the regularity of the blade-to-blade flow field behaviour.

SUMMARY OF THE INVENTION

The present invention provides an array of flow directing elements, such as blades, that include first and second flow directing elements or blades that operate to interrupt a regular element-to-element flow field, changing the flow field from a substantially symmetric flow field, formed when the flow directing elements are all the same, to a substantially asymmetric flow field created by forming the second flow directing elements with a dimensional characteristic that is different than a corresponding dimensional characteristic of the first flow directing elements. The terms "element-to-element flow field" and/or "blade-to-blade flow field", as used herein, refers to a relationship, such as a flow field relationship, established between flow directing elements or blades located on a common row extending circumferentially around a rotor disk in a turbomachine.

In accordance with one aspect of the invention, an array of flow directing elements for use in a turbomachine is provided comprising a plurality of flow directing elements mounted to a rotor disk. Each of the flow directing elements includes a radially extending span dimension and a chord dimension extending substantially perpendicular to the span dimension. The plurality of flow directing elements comprise first flow directing elements forming a first set of flow directing elements and second flow directing elements forming a second set of flow directing elements. An element-to-element flow field defined between successive ones of the first set of flow directing elements is interrupted by the second set of flow directing elements to form an asymmetric element-to-element flow field around the array of flow directing elements.

In accordance with another aspect of the invention, an array of flow directing elements for use in a turbomachine is provided comprising a plurality of flow directing elements mounted to a rotor disk. Each of the flow directing elements includes a radially extending span dimension and a chord dimension extending substantially perpendicular to the span dimension. The plurality of flow directing elements comprises first flow directing elements forming a first set of flow directing elements and second flow directing elements forming a second set of flow directing elements. The second set of flow directing elements has a chord dimension defined by a value that is different than the value of a chord dimension measured at corresponding span-wise locations of the first set of flow directing elements.

In accordance with a further aspect of the invention, an array of flow directing elements for use in a turbomachine is provided to increase flutter stability, the array comprising a plurality of flow directing elements mounted to a rotor disk. Each of the flow directing elements includes a radially extending span dimension and a chord dimension extending substantially perpendicular to the span dimension. The plurality of flow directing elements comprises first flow directing elements forming a first set of flow directing elements and second flow directing elements forming a second set of flow directing elements. The second set of flow directing elements has a chord dimension defined by a value that is smaller than the value of a chord dimension measured at corresponding span-wise locations of the first set of flow directing elements to interrupt a shock field downstream of the flow directing elements and reduce shock induced flutter in the flow directing elements.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
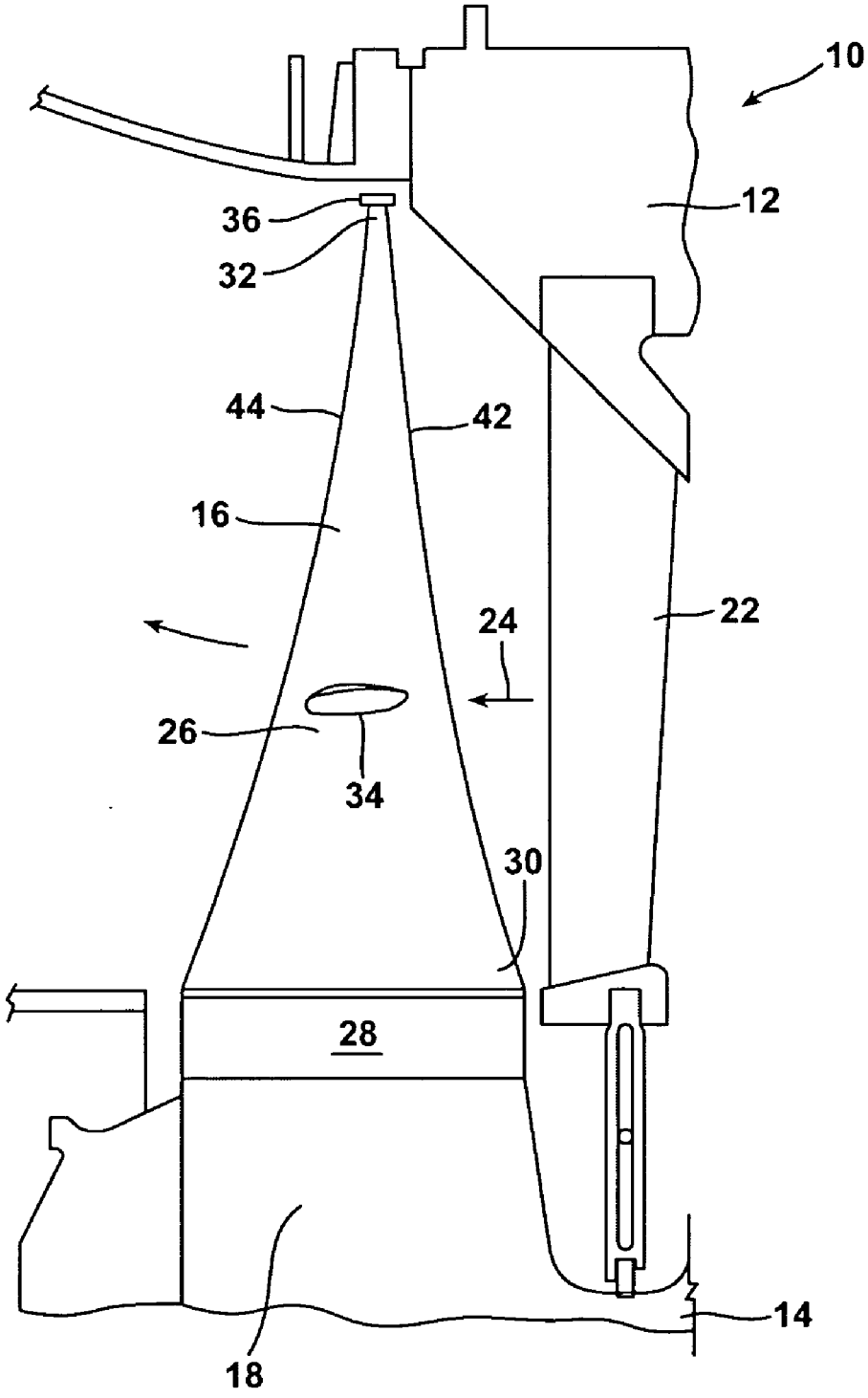
FIG. 1 is a portion of a cross-section through the last stage of a steam turbine, illustrating an example of the blade array for the present invention.

Referring to the drawings, there is shown in FIG. 1 a portion of a cross-section through the low pressure section of a steam turbine 10. As shown, the steam flow path of the steam turbine 10 is formed by a stationary cylinder 12 and a rotor 14. A row of flow directing elements comprising blades 16 are attached to the periphery of a disc portion 18 of the rotor 14 and extend radially outwardly into the flow path in a circumferential array 20 (see FIG. 2). As shown in FIG. 1, the row of blades 16 is the last row in the low pressure steam turbine 10. A row of flow directing elements comprising vanes 22 of a diaphragm structure are attached to the stationary cylinder 12 and extend radially inwardly in a circumferential array immediately upstream of the row of blades 16. The vanes 22 have airfoils that cause the steam to undergo a portion of the stage pressure drop as it flows through the row of vanes 22. The vane airfoils also serve to direct the flow of steam 24 entering the stage so that the steam enters the row of blades 16 at the correct angle. The row of vanes 22 and the row of blades 16 together form a last stage in the steam turbine 10.

Figure 2:
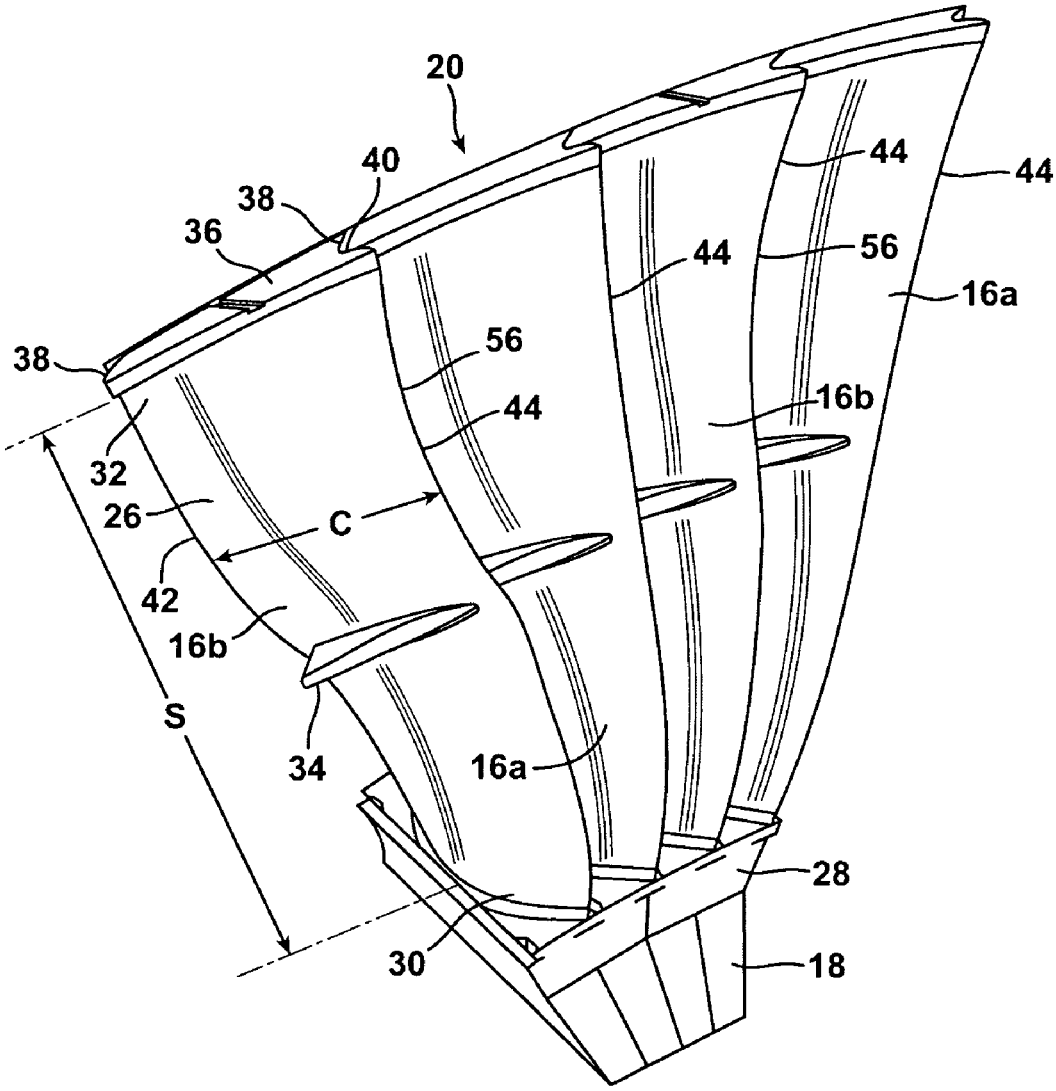
FIG. 2 is a perspective view of a blade array illustrating the concept of the present invention.

As shown in FIGS. 1 and 2, each blade 16 is comprised of an airfoil portion 26 that extracts energy from the steam 24 and a root portion 28 that serves to fix the blade 16 to the rotor 18. The airfoil 26 has a base portion 30 at its proximal end adjacent the root portion 28 in the hub region of the stage and a tip portion 32 at its distal end. Each airfoil 26 is defined in part by a span dimension S extending radially from the base 30 to the shroud, and by a chord dimension C that may be defined at any given point along the span and that extends substantially perpendicular to the span dimension S.

In accordance with the illustrated embodiment, the center section of each blade 16 may also include a front standoff 34 and a rear standoff (not shown), where the front standoff 34 and rear standoff define mid-span snubber members, and where "front" and "rear" are referenced with respect to a turbine rotational direction. The mid-span snubber members each have a distal end defining respective snubber contact surfaces that form a small gap defining a snubber region therebetween.

In addition, a shroud portion 36 may be provided at the tip portion 32 of each of the blades 16. Each shroud portion 36 comprises a front end or contact surface 38 and an opposing rear end or contact surface 40. In the illustrated embodiment, the front and rear contact surfaces 38, 40 of adjacent blades 16 define an interlocking Z-shroud region comprising a small gap located between the contact surfaces 38, 40. When the turbine 10 is in use, the adjacent contact surfaces of the mid-span snubber members, and adjacent front and rear contact surfaces 38, 40 of adjacent shroud portions 32, may rub against each other as the blades 16 bend and twist during rotation of the rotor 14. As described herein, the blades 16 are shrouded blades that form a coupled blade structure; however, it should be understood that the present description may be considered substantially equally applicable to free standing blade structures, e.g., unshrouded blade structures.

As the steam 24 flows across the blades 16, from a leading edge 42 to a trailing edge 44, a flow field will be formed downstream of the trailing edge 44 that will have varying characteristics depending on the speed of the steam 24 passing through a given stage and the rotational speed of the blade 16. Further, the flow field may vary depending on the radial location on the blade 16, where locations along an inner span region of the blade 16 will tend to produce a subsonic flow field, and locations along an outer span region of the blade 16 will tend to produce a supersonic flow field. Flow fields comprising supersonic flows tend to produce aero-elastic instability that is evidenced by shock induced flutter of the blades 16.

Figure 3:
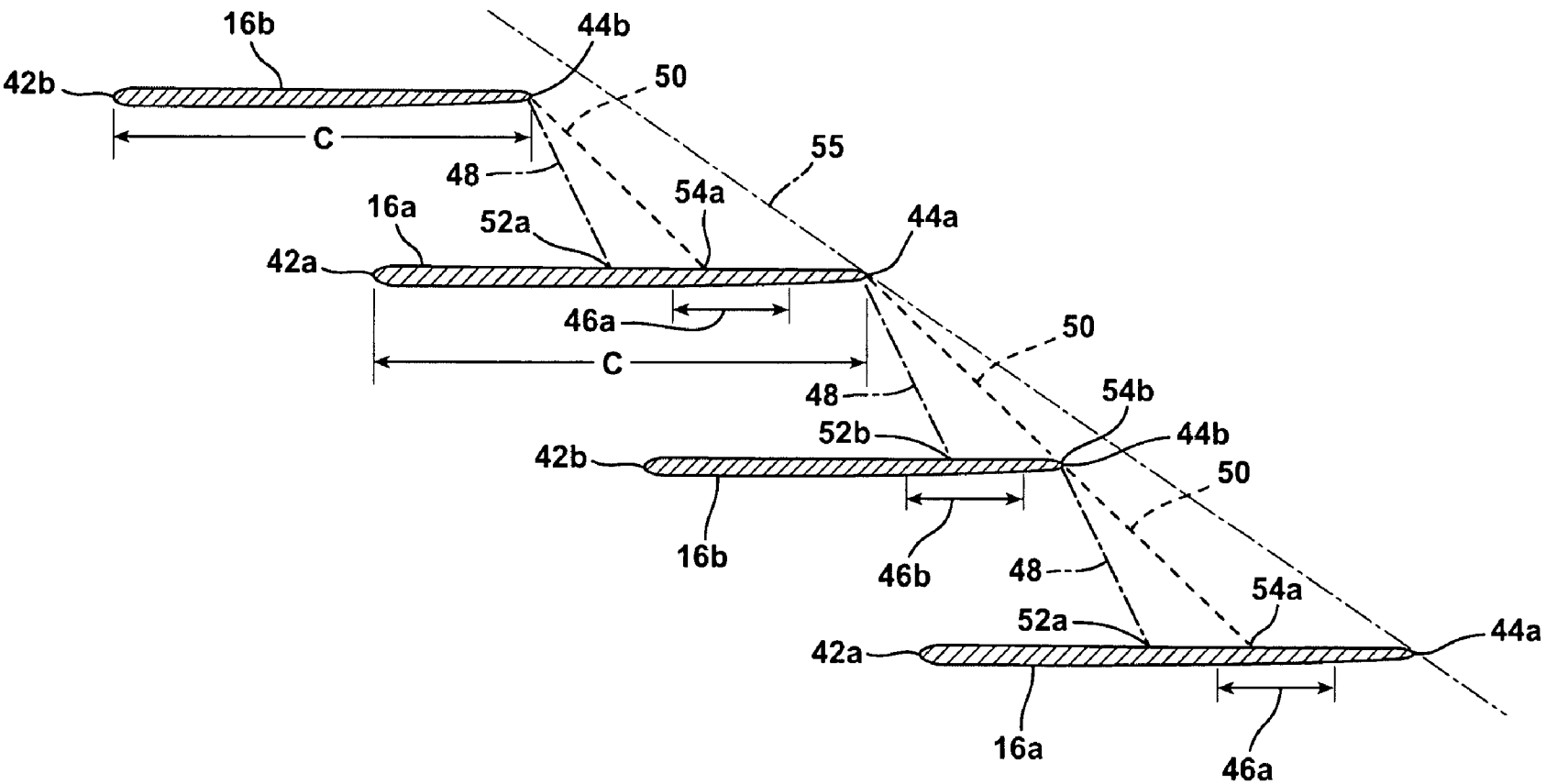
FIG. 3 is a diagrammatic view of the blades of FIG. 2, illustrating a flow field that may be formed by the present invention.

Referring to FIGS. 2-3, a design for the blade array 20 is provided that is proposed for decreasing the influence of the destabilizing forces associated with the flow field, and particularly for decreasing the influence of destabilizing forces associated with a supersonic flow field. In a particular embodiment of the invention, the blades 16 of the array 20 comprise a plurality of first blades 16*a* defining a first set of blades, and a plurality of second blades 16*b* defining a second set of blades. As will be described further below, the first blades 16*a* may be considered a normal or unmodified blade design, and the second blades 16*b* may be considered a modified form of the first blades 16*a*. The chord dimension C of the second blades 16*b* is altered relative to the chord dimension C of the first blades 16*a* at corresponding locations in the spanwise direction along the blades 16, such that at least portions of the trailing edges 44 of the second set of blades 16 are displaced in an axial direction relative to the trailing edges of the first set of blades 16.

As seen with reference to FIG. 3, an unstable region 46*a* is defined for each of the first blades 16*a*, and an unstable region 46*b* is defined for each of the second blades 16*b*. The unstable regions 46*a*, 46*b* comprise regions of the blades 16*a*, 16*b* that are generally located adjacent the trailing edges 44*a*, 44*b* of the blades 16*a*, 16*b*, respectively, where incident shock waves may cause pressure fluctuations that could lead to instability in the blades 16*a*, 16*b*, such as inducing flutter or other unstable responses.

Flow fields having shock forces that create a flutter response in the blades 16*a*, 16*b* will generally occur within a range of exit Mach numbers, defined herein as a critical range of exit Mach numbers, such that the main parameter of concern with regard to the occurrence of flutter is the exit Mach number, which will generally determine the position at which the shock wave will impinge on the blades 16*a*, 16*b*. The shock waves defined within the critical range of exit Mach numbers comprises a range of positions generally defined between a first line 48, representing the shock wave produced by a lower limit exit Mach number, and a second line 50, representing the shock wave produced by an upper limit exit Mach number. The shock wave corresponding to the first line 48 will impinge on the blades 16*a*, 16*b* at axially forward locations 52*a*, 52*b*, respectively, and the shock wave corresponding to the second line 50 will impinge on the blades 16*a*, 16*b* at axially rearward locations 54*a*, 54*b*, respectively, where the locations 54*b* may generally correspond to the trailing edges 44*b* of the second blades 16*b*.

As seen in FIG. 3, shortening the chord dimension C of the second blades 16*b* relative to the corresponding chord dimension C of the first blades 16*a* positions the trailing edges 44*b* of the second blades 16*b* forwardly of a line 55 connecting the trailing edges 44*a* of the first blades 16*a*, and results in a displacement of the shock flow field, i.e., between 52*a* and 54*a*, in an axially forward direction away from the unstable region 46*a* of the first blades 16*a*. Thus, the shock position for the first blades 16*a* is moved forwardly substantially out of the range of the unstable region 46*a*, while the shock position for the second blades 16*b* is shown as remaining substantially within the unstable region 46*b*. The first and second blades 16*a*, 16*b* are illustrated in the present embodiment as being arranged in an alternating pattern around the circumference of the rotor 14 such that only 50% of the blades 16, i.e., the second blades 16*b*, operate in the unstable region, while the other 50% of the blades 16, i.e., the first blades 16*a*, generally operate in the stable region, to provide an overall reduction in the flutter response of the blade array 20.

Figure 5:
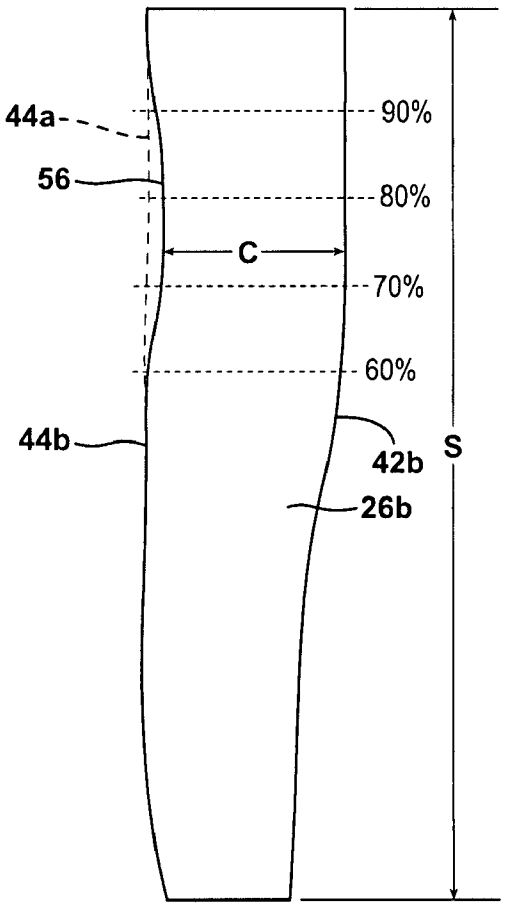
FIG. 5 is an elevation view illustrating a modified blade airfoil that may be provided in a second blade set in accordance with the present invention.
Figure 4:
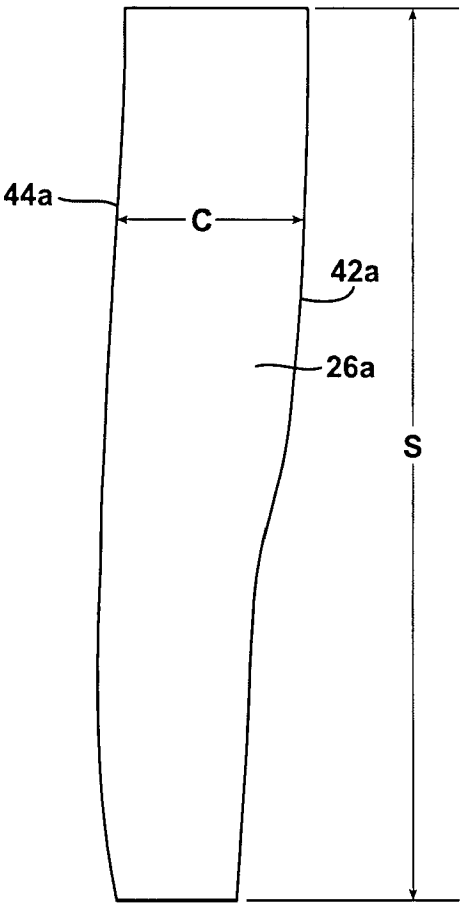
FIG. 4 is an elevation view illustrating a normal or unmodified blade airfoil that may be provided in a first blade set in accordance with the present invention.

Referring to FIGS. 4 and 5, a particular embodiment of first and second airfoil portions 26*a*, 26*b* of the respective first and second blades 16*a*, 16*b* is depicted without the standoffs 34 or shrouds 36. The first airfoil 26*a* shown in FIG. 4 comprises a normal or unmodified airfoil and includes a leading edge 42*a* and a trailing edge 44*a*, and may be compared to the second airfoil 26*b*, comprising a modified airfoil, shown in FIG. 5. The modified second airfoil 26*b* is shown as including a leading edge 42*b* that may be substantially similar to the leading edge 42*a* of the first airfoil 26*a*, although modifications may be made to the leading edge 42*b* as required to obtain a desired airfoil performance. The modified second airfoil 26*b* further includes a trailing edge 44*b* that defines a cut-back region 56 comprising a portion of the trailing edge 44*b* that is cut back relative to a corresponding portion of the edge 44*a*, shown for illustrative purposes as a dotted line in FIG. 5. That is, the cut-back region 56 is defined by points along the trailing edge 44*b* that are displaced axially forwardly from points located at corresponding span-wise locations on the trailing edge 44*a* of the normal or unmodified first airfoil 26*a*.

Since supersonic flow fields will generally occur at outer span portions of the airfoils 26*a*, 26*b*, the cut-back region 56 of the second airfoil 26*b* is defined starting at about 60% of the span length, where it blends with the profile of the unmodified first airfoil 26*a*, and continues to 100% of the span length, where it also blends with the profile of the unmodified first airfoil 26*a*. In the particular described embodiment, the trailing edge 44*b* may be cut back up to approximately 8%, e.g., by providing a generally corresponding reduction in the chord dimension C, at a radial location of about 70% to about 80% of the span length; and the trailing edge 44*b* may be cut back up to 4% at a radial location of about 90% of the span length.

The presently described blade array 20, providing alternating first and second blades 16*a*, 16*b* having normal and reduced chord dimensions C, respectively, operates to interrupt the flow field, changing the flow field from a substantially symmetric flow field, formed when the blades 16 are all the same, to a substantially asymmetric flow field. It should also be noted that the invention is not limited to the particular alternating arrangement of the blades 16*a*, 16*b* described herein and that the second blades 16*b* having modified chord dimensions may be provided in groups and/or may be separated by one or more of the first blades 16*a* having normal chord dimensions. Further, although a particular construction for the second airfoils 26*b* is described herein, the particular proportion(s) of the second airfoils 26*b* provided as cut-back areas 56 with a reduced chord dimension C may be varied to accommodate the particular operational conditions of the turbine.

The principles described herein may be particularly useful when implemented in a strongly coupled system, such as the above-described system including coupling components formed by adjacent contacting surfaces of the blades. Known techniques for reducing flutter by mix-tuning of blades, such as by tuning the natural frequency of blades, may be less effective in coupled systems as a result of the mechanical connection provided between the blades, and the presently described blade array may be provided to reduce the effect of shock forces that induce blade flutter. Further, the presently described blade array may be useful for reducing shock induced flutter in the blades of an uncoupled blade array, either in combination with other flutter and vibration reducing techniques, such as may be provided by altering the natural frequency of the blades, or when provided as a separate solution that may reduce the shock induced influence of adjacent blades in an array.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An array of flow directing elements for use in a turbomachine comprising:

a plurality of flow directing elements mounted on a rotor disk, each said flow directing element including a radially extending span dimension and a chord dimension extending substantially perpendicular to said span dimension;

said plurality of flow directing elements comprising first flow directing elements forming a first set of flow directing elements and second flow directing elements forming a second set of flow directing elements;

said flow directing elements each comprise a leading edge and a trailing edge, and said trailing edges of said second set of flow directing elements are located at a different axial location than corresponding trailing edges of said first set of flow directing elements to define different chordal dimensions for said second set of flow directing elements;

wherein an element-to-element flow field defined between successive ones of said first set of flow directing elements is interrupted by said second set of flow directing elements to form an asymmetric element-to-element flow field around said array of flow directing elements; and wherein each of two or more of said flow directing elements have one or more respective coupling components, each said one or more coupling component having opposite front and rear contact surfaces with respect to a rotational direction of said rotor disk, said one or more coupling components being arranged in such a way that coupling components of two adjacent flow directing elements are brought into contact with each other at adjacent front and rear contact surfaces during rotation.

2. The array of claim 1, wherein said chord dimensions of said second set of flow directing elements differs from said chord dimensions of said first set of flow directing elements at corresponding span-wise locations, extending from a location beginning from about 60% to about 100% of the span of said flow directing elements.

3. The array of claim 1, wherein at least one of said second flow directing elements is located between a pair of said first flow directing elements.

4. The array of claim 3, wherein the trailing edge of said at least one second flow directing element is displaced axially forwardly from a line connecting the trailing edges of said pair of first flow directing elements.

5. The array of claim 4, wherein said trailing edge of said at least one second flow directing element is displaced axially forwardly a distance of up to about 8% of the chord length of said pair of first flow directing elements.

6. The array of claim 1, wherein said one or more coupling components comprises a shroud located at a radially outer end of each of said flow directing elements.

7. An array of flow directing elements for use in a turbomachine comprising:

a plurality of flow directing elements mounted to a rotor disk, each said flow directing element including a radially extending span dimension and a chord dimension extending from a leading edge to a trailing edge substantially perpendicular to said span dimension;

said plurality of flow directing elements comprising first flow directing elements forming a first set of flow directing elements and second flow directing elements forming a second set of flow directing elements;

wherein said second set of flow directing elements has a chord dimension defined by a value that is different than the value of a chord dimension measured at corresponding span-wise locations of said first set of flow directing elements such that the different chord dimensions between the first and second flow directing elements interrupts an element-to-element flow field defined between successive ones of said first set of flow directing elements at said trailing edge of said flow directing elements to form an asymmetric element-to-element flow field around said array of flow directing elements; and wherein each of two or more of said flow directing elements have one or more respective coupling components, each said one or more coupling component having opposite front and rear contact surfaces with respect to a rotational direction of said rotor disk, said one or more coupling components being arranged in such a way that coupling components of two adjacent flow directing elements are brought into contact with each other at adjacent front and rear contact surfaces during rotation.

8. The array of claim 7, wherein said chord dimension of said second set of flow directing elements is shorter than the chord dimension of said first set of flow directing elements.

9. The array of claim 8, wherein said second flow directing elements are positioned alternately with said first flow directing elements around said rotor disk.

10. The array of claim 7, wherein said span dimension comprises an inner span region adjacent to said rotor disk and an outer span region spaced from said rotor disk, and points on said trailing edges of said second set of flow directing elements are located at different axial locations than points located at corresponding span-wise locations of said first set of flow directing elements beginning at said outer region and extending toward a tip of said flow directing elements.

11. The array of claim 10, wherein said points on said trailing edges of said second set of flow directing elements are displaced axially forwardly up to about 8% from points located at corresponding span-wise locations of said first set of flow directing elements.

12. The array of claim 11, wherein said points on said trailing edges of said second set of flow directing elements are displaced axially forwardly about 4% at a radial location of about 90% of the span length.

13. The array of claim 11, wherein said points on said trailing edges of said second set of flow directing elements are displaced axially forwardly about 8% at a radial location of from about 70% to about 80% of the span length.

14. An array of flow directing elements for use in a turbomachine to increase flutter stability comprising:

a plurality of flow directing elements mounted to a rotor disk, each said flow directing element including a radially extending span dimension and a chord dimension extending from a leading edge to a trailing edge substantially perpendicular to said span dimension;

said plurality of flow directing elements comprising first flow directing elements forming a first set of flow directing elements and second flow directing elements forming a second set of flow directing elements;

wherein a portion of said trailing edge of said second set of flow directing elements differs from a corresponding trailing edge portion of said first set of flow directing elements such that said second set of flow directing elements has a chord dimension defined by a value that is smaller than the value of a chord dimension measured at corresponding span-wise locations of said first set of flow directing elements to interrupt a shock field downstream of said flow directing elements and reduce shock induced flutter in said flow directing elements; and wherein each of two or more of said flow directing elements have one or more respective coupling components, each said one or more coupling component having opposite front and rear contact surfaces with respect to a rotational direction of said rotor disk, said one or more coupling components being arranged in such a way that coupling components of two adjacent flow directing elements are brought into contact with each other at adjacent front and rear contact surfaces during rotation.

15. The array of claim 14, wherein said span dimension comprises an inner span region adjacent to said rotor disk and an outer span region spaced from said rotor disk, and points on said trailing edges of said second set of flow directing elements are located at axial locations that are displaced axially forwardly of points located at corresponding span-wise locations of said first set of flow directing elements beginning at said outer region and extending toward a tip of said flow directing elements.

16. The array of claim 15, wherein said second flow directing elements are positioned alternately with said first flow directing elements around said rotor disk.

* * * * *